US011377175B2

(12) United States Patent
Michaeli et al.

(10) Patent No.: US 11,377,175 B2
(45) Date of Patent: Jul. 5, 2022

(54) MODULAR RAMP SYSTEM FOR A LANDING CRAFT

(71) Applicant: Ockerman Automation Consulting, Inc., Anacortes, WA (US)

(72) Inventors: Jennifer Michaeli, Smithfield, VA (US); Robert Walling, Pine Beach, NJ (US); Alden Nelson, Norfolk, VA (US)

(73) Assignee: Ockerman Automation Consulting, Inc., Anacortes, WA (US)

( * ) Notice: Subject to any disclaimer, the term of this patent is extended or adjusted under 35 U.S.C. 154(b) by 27 days.

(21) Appl. No.: 16/825,988

(22) Filed: Mar. 20, 2020

(65) Prior Publication Data

US 2021/0291938 A1 Sep. 23, 2021

(51) Int. Cl.

| | |
|---|---|
| ***B63B 27/14*** | (2006.01) |
| ***B63B 1/08*** | (2006.01) |
| *B63B 35/00* | (2020.01) |

(52) U.S. Cl.

CPC ..... *B63B 27/143* (2013.01); *B63B 1/08* (2013.01); *B63B 2027/141* (2013.01); *B63B 2035/001* (2013.01)

(58) Field of Classification Search

CPC ... B63B 27/00; B63B 27/14; B63B 2027/141; B63B 27/143; B63B 2027/145; B63B 19/08; B63B 2019/083; B63B 2019/086; B63B 1/08; B63B 2035/001

See application file for complete search history.

(56) References Cited

U.S. PATENT DOCUMENTS

| | | | | |
|---|---|---|---|---|
| 2,341,866 A | | 2/1944 | Jackson | |
| 3,483,838 A | * | 12/1969 | Rath | B63H 25/42 114/60 |
| 3,796,176 A | | 3/1974 | Garcia | |
| 4,476,798 A | * | 10/1984 | Backus | B63B 3/08 114/255 |
| 7,028,632 B2 | | 4/2006 | Blank | |

(Continued)

FOREIGN PATENT DOCUMENTS

WO WO-2016120798 A1 * 8/2016 ..... B63B 27/14

OTHER PUBLICATIONS

International Search Report and Written Opinion for PCT Application No. PCT/US2021/023273, dated Jun. 8, 2021.

(Continued)

*Primary Examiner* — Andrew Polay

(74) *Attorney, Agent, or Firm* — Dorsey & Whitney LLP

(57) ABSTRACT

A modular system, which may include a modular ramp for a landing craft, is described. For example, a ramp module according to some embodiments includes an enclosure defining a cavity, wherein the enclosure is configured to be removably received in a watertight recess formed in the hull of the landing craft. The ramp module also includes an extendible ramp operatively coupled to the enclosure and configured to be extended from the enclosure such that the ramp extends from the deck of the landing craft toward a shore to provide a support surface for unloading cargo onto or in close proximity to the shore. The extendible ramp is configured to be substantially fully retracted within the cavity, in some cases the enclosure forming an water tight seal with the recess in the hull and/or sealing the ramp, when retracted, in a water tight manner within its cavity.

20 Claims, 9 Drawing Sheets

(56) References Cited

U.S. PATENT DOCUMENTS

| | | | | |
|---|---|---|---|---|
| 9,168,983 | B2 * | 10/2015 | Lee | B63B 27/143 |
| 10,046,835 | B2 * | 8/2018 | Ryan | B63B 19/08 |
| 11,008,074 | B2 * | 5/2021 | Robertson | B63B 19/08 |

OTHER PUBLICATIONS

Nautical Structures (retrieved Jan. 2020) "Passerelles & Gangways," available online at: http://www.nautical-structures.com/boarding-equipment,passerelles-gangplanks.

* cited by examiner

MODULAR RAMP SYSTEM FOR A LANDING CRAFT

FIELD

The present disclosure relates generally to watercraft, and more specifically to modular systems for a landing craft, such as a modular ramp for the landing of vehicles, personnel, and/or other cargo.

BACKGROUND

A landing craft is a type of small to medium sized watercraft capable of or designed specifically for landing or beaching operations. A landing or beaching operation is an operation in which the boat is deliberately brought to and temporarily held in shallow water (i.e., at a shore), typically done for the purpose of loading and/or unloading cargo (e.g., land vehicles, personnel or other cargo) directly onto the shore. Landing crafts are typically equipped with a ramp, which is most often located at the bow of the vessel. Locating the ramp at the bow of the vessel avoids the need to bring the stern of the vessel, which typically includes the outboard portion of the propulsion system, near shallow water, thus avoiding the risk of damage to the propulsion system and/or the accidental and irreversible grounding of the vessel.

The ramp of existing landing craft is typically a permanent fixture of the vessel and most often it is part of the hull structure. For example, a typical conventional landing craft may have a bluntly shaped bow, which swings down to provide access to the hold of the vessel and also serves as the ramp for loading and unloading cargo. Existing configurations of landing craft, while suitable for the particular purpose of landing cargo, may not be suitable for any other purpose (e.g., high-speed operations in a seaway). Therefore, solutions may be needed for marine vessels that can address one or more of the limitations in existing boats of this type.

SUMMARY

Examples of a landing craft with an interchangeable module are described. In some embodiments, the landing craft includes a hull that has a bow, a stern, and a deck spanning at least a portion of the distance between the bow and the stern. The landing craft further includes a receiver structure that is secured to the hull within a recess formed in the deck, and a module removably coupled to the receiver structure. The module may be interchangeable, and any of the interchangeable modules may include a different combination of internal components provide various function, or no function at all in some cases. In some embodiments, the module includes an enclosure removably coupled to the receiver structure, and an extendible ramp that retracts substantially fully within the enclosure and which is extendible toward a shore to provide a support surface for loading and unloading of cargo onto the shore. In some embodiments, the enclosure is configured to enclose the ramp within the enclosure in a watertight manner. In some embodiments, the landing craft further comprises a door configured to close an opening in the enclosure sized to accommodate passage of the ramp therethrough. In some embodiments, the door is pivotally coupled to the enclosure at a hinge line parallel with the deck. In some embodiments, the ramp provides a first ramp surface and wherein the door, when opened, provides a second ramp surface extending from the deck to the first ramp surface. In some embodiments, the receiver structure is configured to slidably couple with the enclosure. In other embodiments, the enclosure and receiver structure may be configured for coupling by lowering the module into the receiver structure, for example along the direction of coupling and, optionally, including rotating the module while moving the module toward the receiver structure, for operatively positioning the module within the receiver. The module, and more specifically, the enclosure may be substantially rigidly coupled to the receiver structure using any suitable technique, such as by welding, fastening (e.g., bolting), or other attachment technique. In some embodiments, the interface between the receiver structure and the enclosure is watertight when the module is coupled to the hull.

In some embodiments of the landing craft has a transom stern in that the stern comprises a transom and the ramp enclosure is received in a cavity which is adjacent to and extending forward of the transom towards the bow. In some embodiments, the enclosure forms a watertight interface with surfaces of the deck and the transom. In some embodiments, the landing craft is a stern-to beaching craft and wherein the extendible ramp is operable to extend from the transom towards the shore when the landing craft is beached at the shore with the transom facing the shore. In some embodiments, the enclosure is configured to be received in a recess defined by a first recessed surface located below a surface of the deck, a second recessed surface located forward of the transom, and a pair of opposing side surfaces, each extending between a respective side of the first and second recessed surfaces. The module of any of the embodiments herein may be one of a plurality of modules, for example a first module, and the landing craft may be provided with a second module configured to be interchanged with the first module (i.e. to be removably coupled to the receiver structure in place of the first module), and the second module may include a ramp with different configuration. For example, the extendible ramp of the first module may be configured to support passage of a first type of cargo, wherein the second module comprises an extendible ramp configured to support passage of a second type of cargo but not the first type of cargo. In some embodiments, the second module may provide a different function than a ramp for shore landing, for example the second module may include a ramp or platform for launching a smaller watercraft in water, a lift mechanism and/or grapple structure(s) such as a hook, arm or other, e.g., for depositing or retrieving watercraft, personnel or other from the water, or any other desired functionality.

In accordance with some embodiments of the present disclosure, a modular ramp system for a landing craft includes a ramp module configured to be removably coupled to a hull of the landing craft. The ramp module according to some such embodiments includes an enclosure defining a cavity therein, wherein the enclosure is configured to be removably received in a watertight recess formed in the hull of the landing craft, and an extendible ramp operatively coupled to the enclosure and configured to be extended from the enclosure such that the ramp extends from the deck of the landing craft toward a shore to provide a support surface for unloading cargo onto the shore, and wherein the extendible ramp is configured to be substantially fully retracted within the cavity. In some embodiments, the enclosure is configured to seal the cavity watertight when the ramp is retracted within the cavity. In some embodiments, the door is operatively coupled to the enclosure to cover an opening in the enclosure sized for passage of the extendible ramp therethrough. In some embodiments, the door is hinged to the enclosure at a hinge line parallel with the deck. In some embodiments, the door is configured to pivot upward and away from a transom of the landing craft for opening the door and wherein the door is further configured to provide a ramp between the deck surface and the support surface of the extendible ramp.

In some embodiments, the extendible ramp includes one or more telescoping ramp structures. In some such embodiments, the extendible ramp includes a first telescoping member and a second telescoping member spaced apart from the first telescoping member by a gap, the first telescoping member, when extended, providing a first support surface of sufficient width to accommodate a passage of a vehicle tire over the first support surface, and a second telescoping member, when extended, providing a second support surface of sufficient width to accommodate the passage of a vehicle tire over the second support surface. In some embodiments, the first and second telescoping members are operatively connected to extend and retract together. In some embodiments, the enclosure is configured to slidably couple to a receiver structure formed within the recess in the deck of the landing craft. In some embodiments, the enclosure is configured to be coupled to a recess formed in a stern portion of the hull such that the extendible ramp is operable to extend from the stern of the landing craft toward the shore. In some embodiments, the enclosure is configured to be received in a recess defined by a first recessed surface located below a surface of the deck, a second recessed surface located forward of the watercraft's transom, and a pair of opposing side surfaces, each extending between a respective side of the first and second recessed surfaces. In some embodiments, the enclosure forms a watertight interface with the surface of the deck and the transom. In some embodiments of the modular ramp system, the ramp module is a first module, the system further comprising a second dummy module configured to be removably coupled to the hull of the landing craft, the second dummy module comprising a dummy enclosure having a same geometry and coupling interface as the enclosure of the first module, wherein the second dummy module does not include a ramp. In some embodiments of the modular ramp system, the ramp module is a first module and wherein the extendible ramp of the first module has a first configuration, the system further comprising a second ramp module comprising a second enclosure configured to be removably coupled to the watertight recess in the hull of the landing craft, the second ramp module further comprising a second extendible ramp having a second configuration different from the first configuration.

Various embodiments of modular ramp systems, and landing crafts configured for removably receiving a modular system, e.g., within a watertight cavity formed in the hull, are described herein. Also described here are various examples of method for changing the ramp of a landing craft.

BRIEF DESCRIPTION OF THE DRAWINGS

The description will be more fully understood with reference to the following figures in which components may not be drawn to scale, which are presented as various examples of the modular ramp system for landing craft and should not be construed as a complete depiction of the scope thereof.

DETAILED DESCRIPTION

The present disclosure pertains to a landing watercraft which is equipped with a modular system that may be removably and/or interchangeably coupled to the hull of the vessel, for example a modular stern ramp that can be used for loading and/or unloading cargo during a beaching operation. As described, ramps of existing landing crafts are typically fixed and form part of the boat's hull. As such, existing landing craft are only equipped with a single type of ramp. Typical landing crafts are configured as bow landing crafts, where the bow ramp is fixed and is, thus non-reconfigurable for different purposes or use cases. Often the ramp of existing landing craft may need to be oversized to be able to support loading and unloading of both vehicles and personnel. Also, integrated bow ramps perform poorly at high speeds and/or in rough conditions. In general, providing a landing ramp as is conventionally known, may introduce shortcomings or inefficiencies in the design of a boat, making it potentially undesirable for any boat intended for multi-purpose operation. A boat according to the present disclosure may include modular stern ramp. The modular system, in some cases a modular ramp system, may be removable without affecting the seaworthiness of the vessel. In some embodiments, the ramp may not only be modular but may also be mounted to the boat in an interchangeable manner thereby allowing the ramp module to be removed for replacing it with a ramp module that includes a ramp having a different configuration (e.g., size and/or load-bearing capacity), and/or with a module containing one or more components that does not include a ramp but provide a different functionality, or in some cases with a dummy module that does not include a functional component within its cavity.

Figure 1:
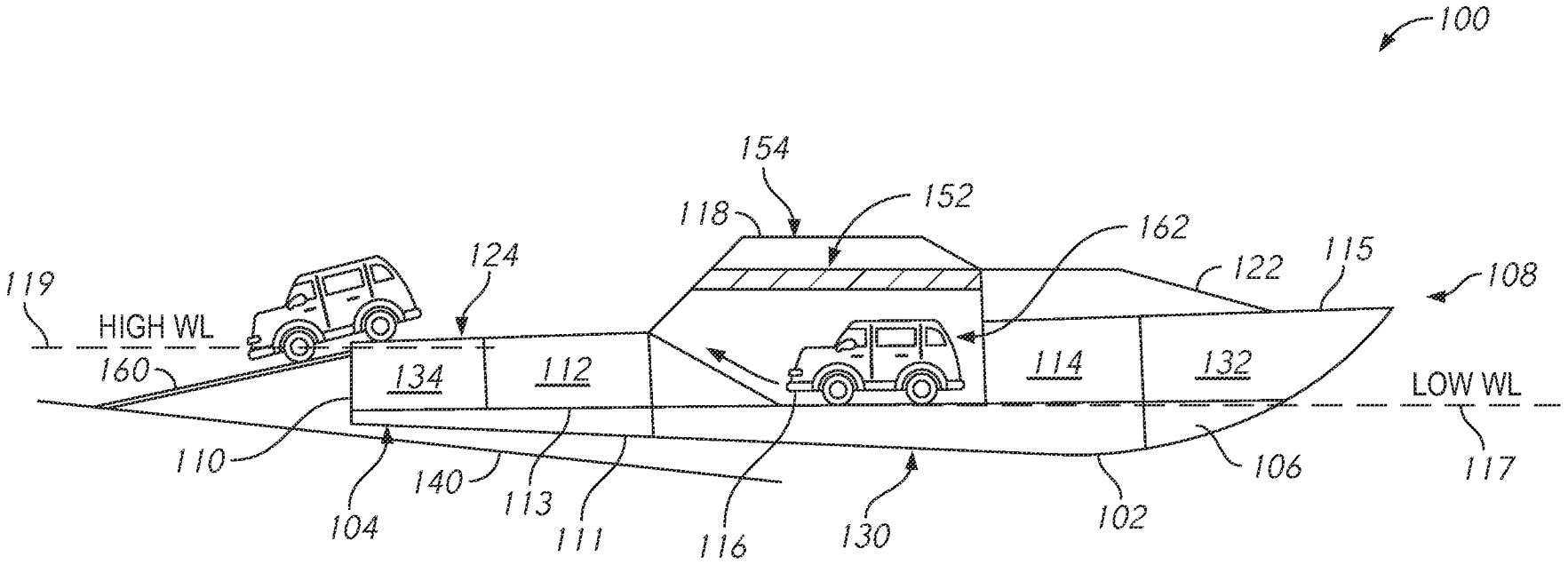
FIG. 1 is a simplified profile view of a boat in accordance with examples of the present disclosure.

FIG. 1 shows an illustration of a boat 100, configured to operate as a landing craft, which implies that the boat 100 is capable of approaching a shoreline and being intentionally temporarily beached for loading and/or unloading cargo. In the illustrated example, the boat 100 is configured as a stern-to landing craft, which means that the boat 100, for example its hull form, is configured to enable the boat 100 to approach the shoreline with its stern and land the boat 100 with the stern oriented towards the shoreline. However, in other examples, the boat may be configured to approach a shoreline differently (e.g., with the how oriented towards the shore). In such embodiments, the boat 100 may have a module (e.g., a ramp module) removably attachable to and detachable from a receiver structure located in a different location of the hull, such as near the bow or near one of the outboard (e.g., the port or starboard) sides of the boat. In such embodiments, the receiver structure and the module may have different geometries than those of the examples herein, which may depend upon the geometry of the hull portion to which the module is attached.

The boat 100 has an outer hull, or simply hull, 102, which has a bow 108 and a stern 104. The stern portion of boat 100 is illustrated here as a transom stern, and as such the stern portion of the boat 100 terminates at a transom 110. One or more propulsors (e.g., a shaft-driven propeller, a waterjet, or any other type of propulsor and/or combinations thereof) may be operatively aft in the vicinity of the transom 110 to provide propulsive force or thrust to propel the boat in water. The boat 100 may include a lower hull portion (or simply lower hull) 106, which is the portion of the boat 100 that may come into contact with water when the boat is in the water, may include an outer surface that is generally watertight. The term watertight implies that the structure, interface, or seal so described is sufficiently watertight so as not to compromise the seaworthiness of the boat 100. As such a watertight structure, interface or seal may be at least water resistant (or weather-tight) without necessarily being completely impervious to water. In some embodiments, the structure, interface, or seal described as watertight may be completely watertight (e.g., water-impermeable or waterproof, under water pressure during standard operations of the boat). In some embodiments, the boat 100 may include an upper hull portion (or simply upper hull) 122, which may be jointed to the lower hull 106 and may extend from the lower hull 106 at the sheer line 115.

The hull 102 of the boat 100 defines an interior volume or hull cavity. The boat 100 may include one or more functional areas, such as a control area or bridge 114, an engine room 112, and a cargo bay 116, one or more of which may be substantially fully enclosed within the hull cavity in some embodiments. These functional areas may be provided in internal (e.g., substantially watertight or dry) compartments of the boat. In some embodiments, the lower and upper hulls may substantially fully enclose the internal (dry) compartments of the boat. In other embodiments, the boat may not have an upper hull portion 122 or it may have an upper hull that encloses and/or seals only a portion of the interior volume defined by the hull 102.

The boat 100 may include a deck which may span at least a portion of the distance between the bow and the stern. In some embodiments, the boat may have an exposed deck surface (e.g., below the sheer line). In some embodiments, the deck may be at least partially, and in some cases fully enclosed by the hull (e.g., in embodiments in which the boat includes an upper and lower hull portions). In some embodiments, the deck may include a portion that is enclosed and a portion that is exposed. For example, the boat may have an internal deck, the deck surfaces of which are substantially enclosed or covered by the portions of the hull (e.g., by a cargo bay canopy or within a crew compartment). In some embodiments, a portion of the hull (e.g. a portion of the upper hull) may function as a deck, such as by being configured to support the weight of cargo 162, such as equipment, vehicles, and/or personnel. In some embodiments the boat may have a an enclosed deck, which connects to a portion of the upper hull that functions as an exposed deck, such as to provide a deck surface connecting one compartment of the boat (e.g., a cargo bay) to another area of the boat (e.g., the stern of the boat and/or landing ramp, which may be located at the stern).

The hull 102, and specifically the lower hull 106, may have a v-shaped bottom 101, which may facilitate operating the boat 100 as a planing craft. The v-shaped bottom 101 portion of the hull 102 may be defined by generally flat or curved surfaces extending from the bottom or keel line 111 to chine 113, which may allow the vessel 100 to be fast and maneuverable on the water, particularly when operated as a planing craft. In some embodiments, the bottom portion 101 of the hull 102 may be equipped with strakes or other suitable structures, such as to enhance the lift and/or stability of the vessel while in planing mode. In other embodiments, the boat 100 may have a round bottom hull, a flat bottom hull or any other hull form of suitable configuration. Furthermore, the hull 102 can comprise multiple longitudinal hull portions such as in a twin-hull, a tri-hull, and m-hull design or other.

In some embodiments, at least a portion of the deck of the boat 100 may be enclosed or covered, for example as shown here by a canopy 118. In some embodiments, the boat 100 may be equipped with a modular canopy system which changes the overall hull profile or shape of the boat 100 with ease (e.g., without re-design or building a new vessel), thus enabling the capacity of the cargo bay 116 and/or the operational capabilities of the boat 100 to be varied as may be desired. For example, the modular canopy system may enable the boat 100 to be re-configured between a short cargo configuration 152 and a tall cargo configuration 154 by simply interchanging the modular canopy 118. The modular canopy system may be implemented in accordance with any of the examples in patent application U.S. Ser. No. 16/825,792, titled "Modular Cargo Bay Canopy," which is incorporated herein by reference in its entirety.

In some embodiments, the boat 100 may be configured as a variable displacement watercraft allowing the displacement achieved by the hull 102 to be varied as desired. To that end, the boat 100 may include an internal ballast system 130 which includes a plurality of ballast tanks operable to be selectively filled or emptied for changing the weight of the boat and its distribution (e.g., longitudinally) and thus in turn affecting the operational displacement and operational location of the CG of the vessel. In the illustrated example, the boat 100 include a first (or forward) ballast tank 132, which is shown here as extending substantially from the bow to a forward bulkhead just forward of the bridge 114. The ballast system 130 further includes a center ballast tank 136 located aft of the forward bulkhead and spanning substantially the full length of the bridge 114 and cargo bay 116. The ballast system 130 also includes an aft ballast tank 134, shown here as extending along at least a portion of the engine room (e.g., below the engine room) and substantially all the way to the transom 110. In examples, the boat 100 may have any suitable number of ballast tanks, for example two or more tanks, which may be longitudinally distributed along the length of the boat, or otherwise suitably arranged for selectively varying the displacement of the boat 100. Any of the ballast tanks (e.g., center tank 136 or aft tank 134) may be further subdivided longitudinally for additional LCG control. The ballast tanks may have complex geometries, such that any portion of the hull cavity that is not otherwise occupied by a functional area may be used for ballast, which may maximize the available ballast volume and allow for sufficient longitudinal subdivision of the ballast volume to achieve a desired amount of Lai control (e.g., for supporting a beaching operation, which may be accompanied by redistribution and/or removal of cargo from the boat). As cargo is loaded or unloaded from the boat 100, active LCG control may be used to tolerate the LCG shifts caused by redistribution of weight and to compensate for such LCG shifts thereby allowing the boat be re-trimmed and/or provided in a desired trimmed configuration. The variable displacement features and active LCG control of the boat 100 may be implemented in accordance with any of the examples in concurrently filed patent application U.S. Ser. No. 16/826,044, titled "Variable Displacement Landing Craft," naming inventors Jennifer Michaeli, Robert Walling, and Alden Nelson, the content of which is which is incorporated herein by reference in its entirety.

As further shown in FIG. 1, the boat 100 may include a deck 124, shown here as located at the stern and thus also referred to as stern deck 124, which is configured to accommodate the passage of cargo over it. In some embodiments, the deck 124 may be provided by a portion of the upper hull 122. For example, a portion of the upper hull 124 may be configured to have sufficient structural integrity to support the weight of any desired cargo over that portion of the upper hull. Additionally and optionally, the deck 124 may include surface features and/or surface treatment to increase the frictional coefficient of that surface such as to increase traction for any cargo passing over the upper deck 124. In some embodiments, the surface features and/or treatment may be concealable when not in use (e.g., by a retractable hull portion configured to extend over the deck). As also shown in FIG. 1, the boat 100 may be equipped with a ramp 160, which may in some embodiments be provided by a modular ramp system as described further below. The ramp 160 may be positioned anywhere on the boat 100, but in this example the ramp 160 is configured to extend from the stern 104 of the boat 100 toward a shore 140 for unloading cargo 160 onto or in close proximity the shore. The ramp 160 may be configured to provide a support surface that can support the passage of various types of cargo 162 over it for unloading (or loading) of the cargo 162. In some embodiments, the ramp 160 may be integrated into the boat 100 as part of a modular system (e.g., to enable easy removal and replacement with, for example, a ramp having a different configuration). Such a modular ramp system may be used to unload or load cargo to and from other locations or structures (e.g., other than the beach or shore 140 illustrated in FIG. 1), for example to or from a dock, another vessel, or directly onto or from the water surrounding the boat 100.

Referring now also to the illustrations in FIGS. 2-5, a modular ramp system 206 in accordance with some embodiments of the present disclosure will be described. The system 206 in FIG. 2 includes a ramp module 202 configured to be removably attached to the hull 102, in this case to the stern portion, of a landing craft (e.g., boat 100). The ramp module 202, in this example, is secured to the stern of the boat 100, which may be configured to operate as a stern-to landing craft. Thus, when extended, the ramp 210 may extend from the stern of the boat towards the location or structure (e.g., a shore) from or onto which cargo is being loaded or loaded. In some embodiments, a beaching operation or landing, such as for the loading and unloading of cargo, may be accomplished without the keel of the boat 100 coming into physical contact with the shoreline. For example, the propulsion system (e.g., main propulsors(s), bow thrusters, etc.) may communicate with a dynamic positioning system of the boat 100 to enable an operator (e.g. manual or autopilot) to position and maintain the boat 100 in close proximity to, but without physical contact with, the shore such that when the ramp (e.g., ramp 160, or 210) is deployed any water depth at the ramp does not prevent the loading or unloading of cargo (e.g., a vehicle). In some embodiments, the ramp module 202 may be secured elsewhere on the hull 102 (e.g., proximate either the port or starboard side of the boat, or near the bow of the boat). In yet other embodiments, the module may provide a different functionality or no specific functionality other than to fill the receiver structure in the hull such as to complete the shape of the hull to provide a desired hull profile.

Figure 2:
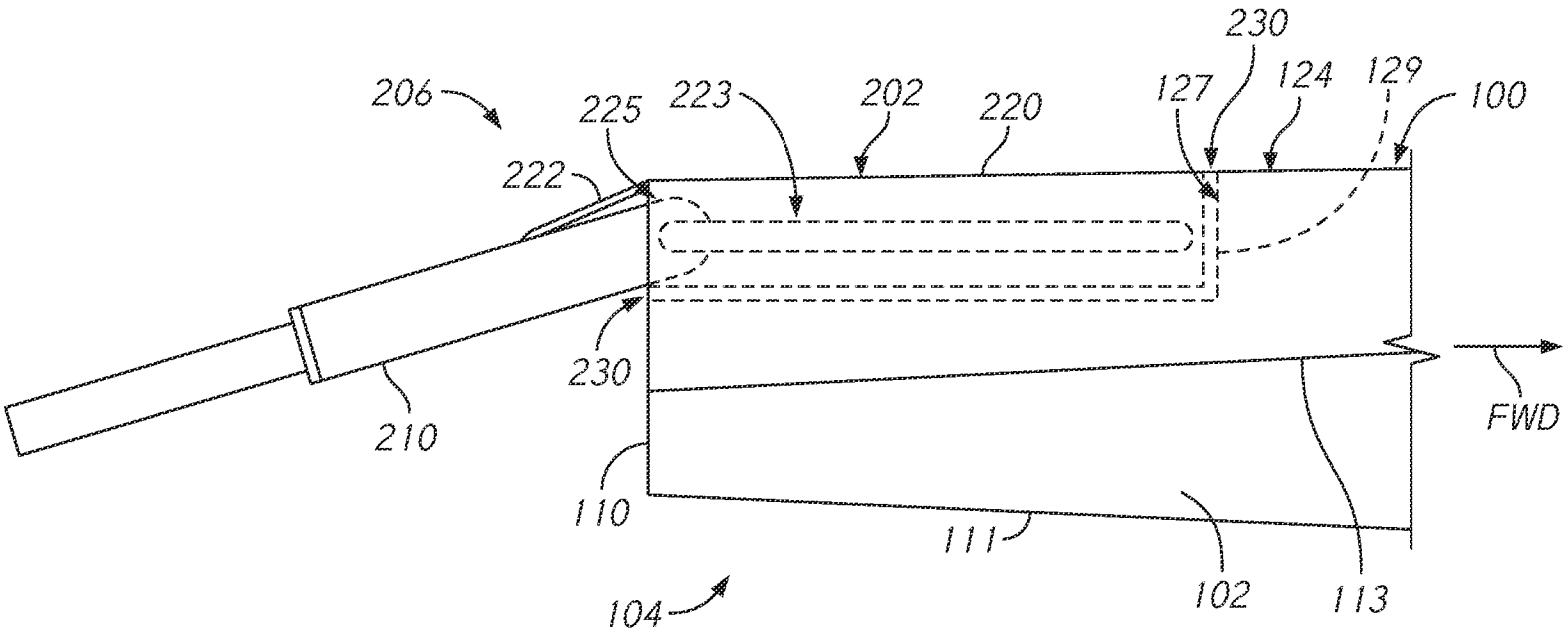
FIG. 2 is an enlarged simplified profile view of the stern portion of the boat in FIG. 1.

The ramp module 202 shown in FIG. 2 includes an enclosure 220, which is configured to be removably coupled to a recess 127 in the hull 102, e.g., without affecting the seaworthiness of the boat 100. For example, the recess 127 may be a watertight recess such that the seaworthiness of the vessel remains unaffected whether or not the module 202 is coupled to the recess. The watertight recess may be formed by a receiver structure 129, which is secured to an opening in the hull 102. The receiver structure 129 may have any suitable shape or geometry to seal the opening in the hull and to provide a coupling interface 230 for removably coupling the module 202 thereto.

Figure 3:
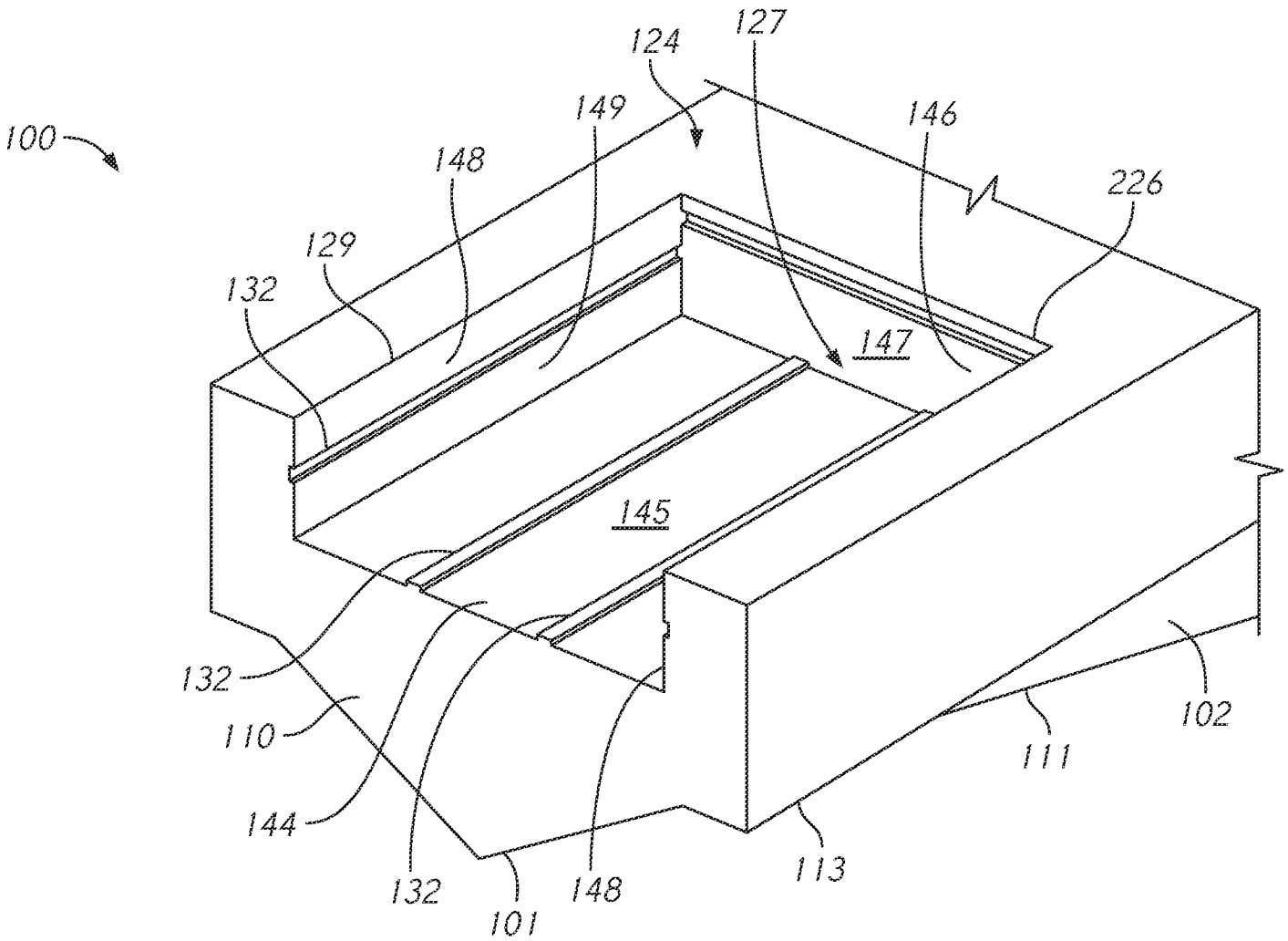
FIG. 3 is an isometric simplified view of the stern portion of the boat in FIG. 1.

For example, as shown in FIG. 3, the receiver structure 129 may include a plurality of walls that function as water-impermeable outer surfaces of the hull 102 whenever the module 202 is not installed on the boat 100. In the example in FIG. 3, the receiver structure 129 includes a first wall 144, a second wall 146, and a pair of side walls 148, such that then the receiver structure 129 is secured to the hull, the receiver structure forms the cavity or recess 127 defined by a first recessed surface 145 located below the surface of the deck 124, a second recessed surface 147 located forward of the transom 110, and a pair of opposing side surfaces 149 disposed on opposite sides of the boat's centerline. The opposing surfaces 149 may be substantially parallel in some examples, or they may be inclined toward centerline of the boat to provide a narrowing taper to the recess 127 in the forward longitudinal direction (i.e. from the transom towards the stern). The first recessed surface 145 may be substantially parallel to the surface of the deck 124. In some embodiments, the first recessed surface 145 may have an incline such that the end of the surface 145 near the transom 110 is located elevationally below the end of the surface 145 located farther away from the transom (or near the second recessed surface 147). In other embodiments, the first recessed surface 145 may be inclined in the opposite direction, with the forward end of the surface 145 (near surface 147) located elevationally below the rear end of surface 145 (near the transom 110). Any suitable configuration that facilitates removably inserting or otherwise removably installing the module 202 within the recess 127 may be used.

Figure 10A:
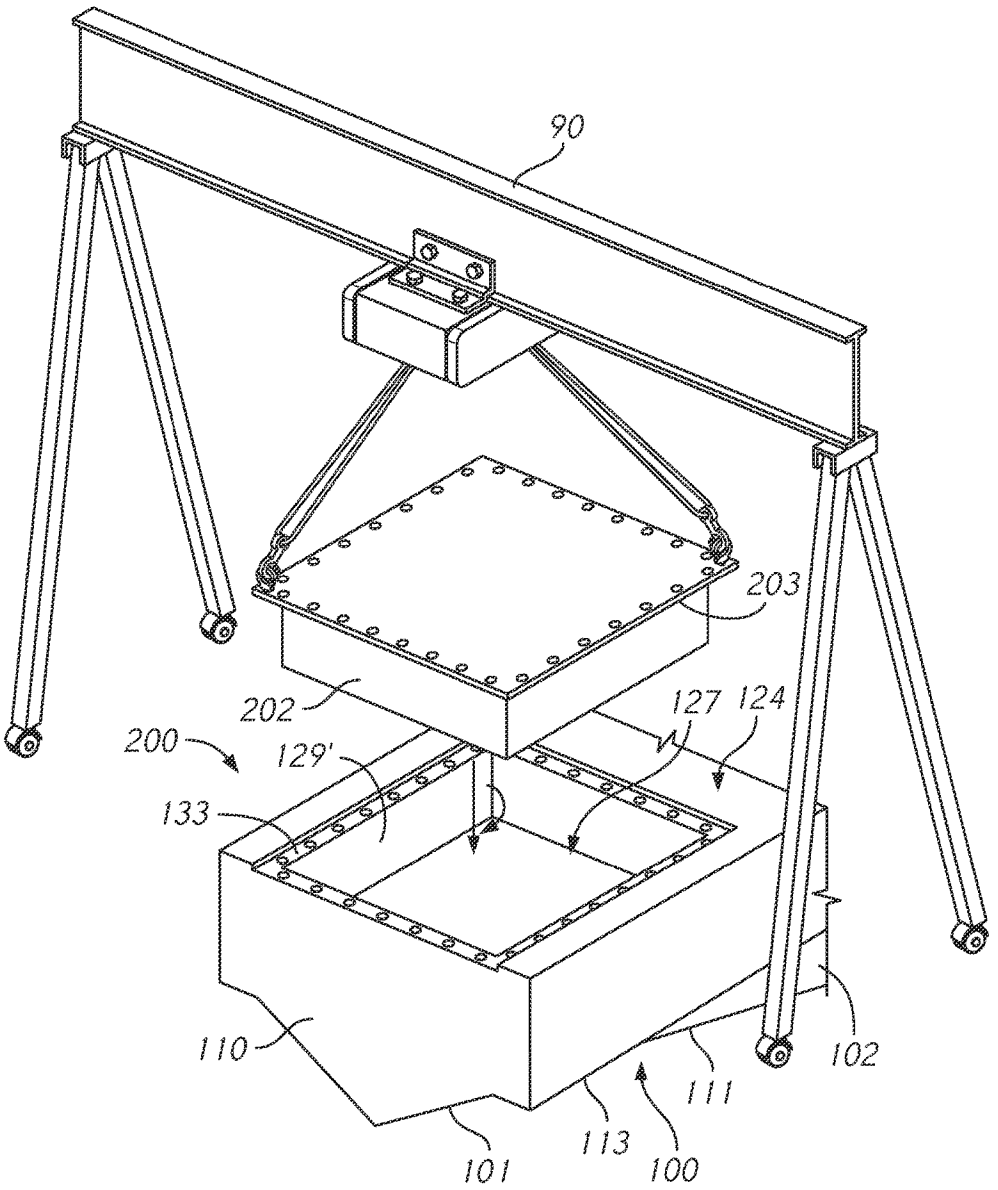
FIG. 10A illustrates an example of a method for installing a module, such as the ramp module in FIG. 2, in accordance with further examples of the present disclosure.
Figure 10B:
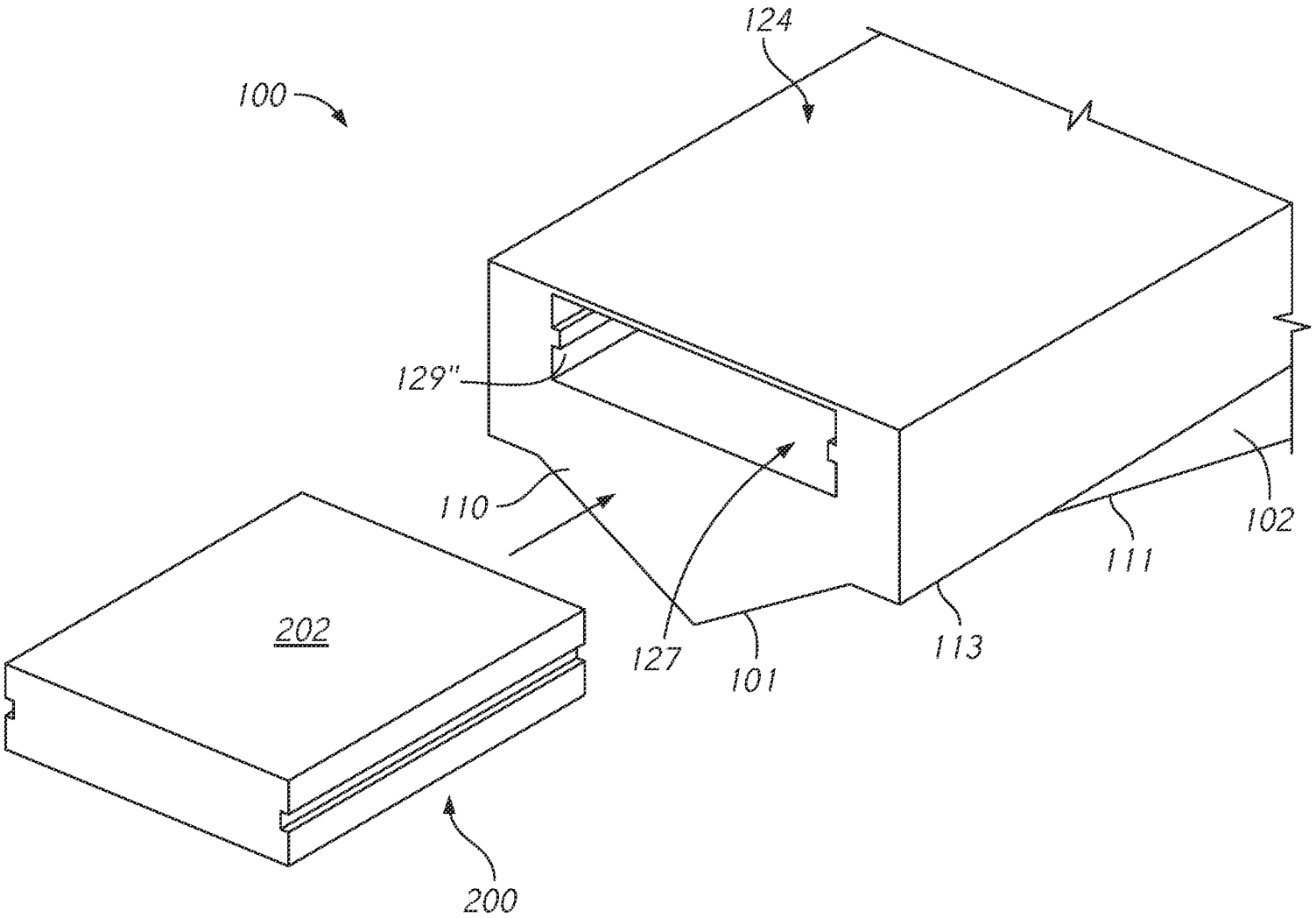
FIG. 10B illustrates another example of a method for installing a module, such as the ramp module in FIG. 2, in accordance with further examples of the present disclosure.

The receiver structure 129 of this example forms a recess 127 having an opening or mouth that interrupts the surfaces of the deck 124 and the transom 110. When the module 202 is installed in the receiver structure, the enclosure 220 may substantially fill the recess 129, with the upper and rear surfaces of the enclosure filling the cutout portions of the deck and transom surfaces. In other embodiments, the recess may be differently configured. For example, in other embodiments, the recess may only have an opening or mouth that interrupts the surface of the transom 110 and the entire cavity or recess may be located below deck 124, e.g. as shown in FIG. 10B. In the example in FIG. 10B, the surface of the deck 124 is substantially uninterrupted by the inclusion of a modular system 200 (e.g., module 202) in the boat 100, which in this example is configured for installation or insertion into the recess 127 defined by the receiver structure 129" by moving (e.g., sliding) the module 202 along a direction substantially normal to the transom 110. In yet other examples, the recess may be configured to have an opening or mouth that interrupts generally only the deck 124 surface and thus the cavity or recess may be located entirely forward of the transom 110, e.g. as shown in FIG. 10A. In the example in FIG. 10A, the transom 110 is substantially uninterrupted by the inclusion of a modular system 200 (e.g., module 202) in the boat 100, which in this example is configured for installation or insertion into the recess 127 defined by the receiver structure 129' by moving the module 202 along a direction substantially normal to the deck 124, such as by lowering the module 202 into the cavity 127 from a location above the deck 124. In some embodiments, the module 202 may be too heavy for manual installation and may be inserted (e.g., slid or lowered) into the cavity by a crane or other suitable gantry structure 90, e.g., as shown in FIG. 10A. Installation or insertion of a module 202 may involve aligning the module 202 with the mouth of the cavity 127 and moving the module 202 toward the cavity 127 (e.g., substantially normal to the surface in which the mouth of the cavity is formed), and optionally rotating the module into position and/or engagement with the receiver structure, once at least a portion of the module 202 is within the cavity. In some such embodiments, in which the recess lacks a vertical mouth, a drain system (not shown) may be installed to drain any fluid (e.g., water) that may accumulate in the recess in the absence of a module therein. Various other configurations for the receiver structure and resulting recess may be used depending on the configuration of the module 202 and/or its location in the hull.

The module 202 in any of the examples herein may be secured to the receiver structure (e.g., receiver structure 129') using any suitable mechanism (e.g., bolting, welding, clamping, or latching). For example, the module 202 may alternatively or additionally to other engagement (e.g., a slidable interface) between the enclosure and receiver structure be bolted to the receiver structure, such as via a flange 203 as shown in FIG. 10A. The flange 203 may extend peripherally near the side of the enclosure 220 that would provide continuity in the interrupted surface of the hull when the module 202 is installed, for example near the top side of the module 202 as shown in FIG. 10A. To provide a watertight interface, one or more seals (e.g., gasket 229) may be provided at any of the seams of the coupling interface 230 that would be exposed to the environment (e.g., to water and/or weather) when the boat 100 is in use (e.g., travelling in a seaway).

Figure 11B:
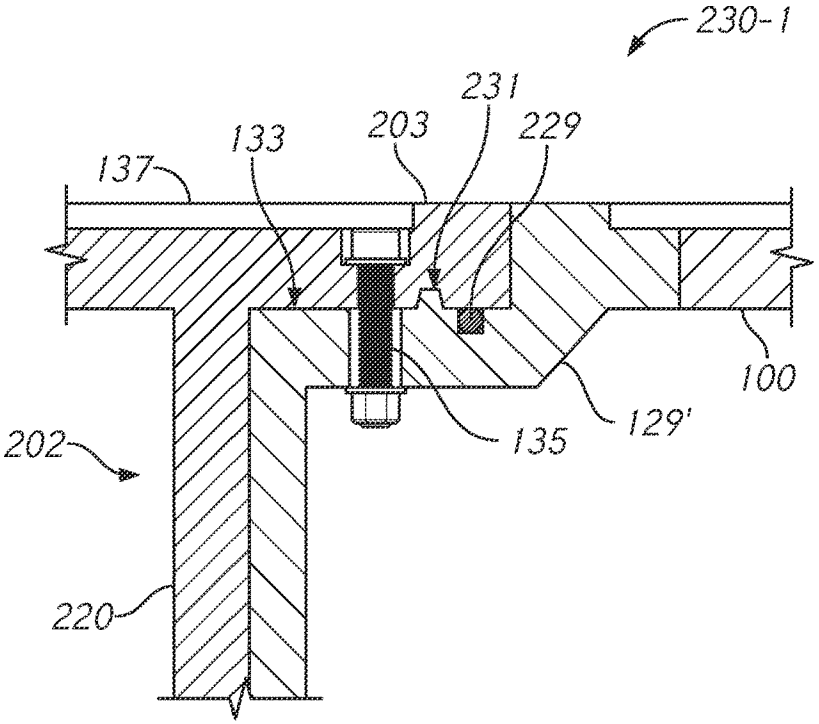
FIGS. 11A and 11B illustrate examples of a coupling interface between a module and a receiver structure of a boat.
Figure 11A:
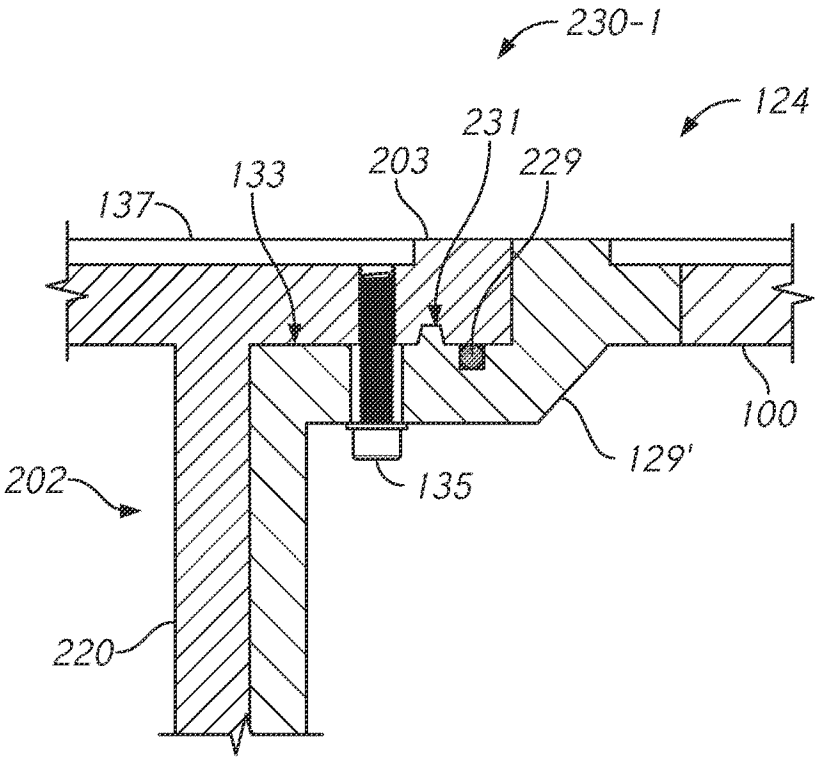

An example coupling interface 230-1 is shown in FIG. 11A. The enclosure 220 of module 202 may be provided with a peripheral flange 203, which may have any suitable shape (e.g., a rectangular or generally wedge shaped, also referred to as knife edge, as shown in FIG. 11A). The receiver structure 129' may have a mating recess 133 configured for a cooperating fit with the flange 203. For example, in the case of a wedge-shaped flange, the recess 133 may be defined by a tapered recess that transitions a wider opening of the mouth to the main cavity of the receiver structure. The recess 133 may extend substantially coextensively with the flange 203, for example in the case of a flange that extends around the full perimeter of the module 202, the recess 133 may also be a peripheral recess. A locating or indexing feature 231 may be provided at the coupling interface 230 which may facilitate proper alignment of the module 202 to the cavity defined by the receiver structure 129'. The module 202 may be rigidly coupled to the receiver structure such as by fastening (e.g., bolting or otherwise fastening) the flange 203 to the mating recess 133. The coupling interface 230-1 may be configured such that the fasteners 135 are angled to the deck 124 surface when the module 202 is installed in the receiver structure 129'. The flange 203 may be fastened from the underside of the deck 124 surface, as shown in FIG. 11A, or from the side of the deck 124 surface, as shown in FIG. 11B. In either example, optionally a cover plate 137 may be installed (e.g., adhered) to the outer side of the enclosure 220 for example to cover the access points for installing fasteners 135 and/or for aesthetics or other reasons. The cover plate 137 and/or fasteners, such as in cases where no cover plate is used, may be recessed (e.g., countersunk in the case of fasteners) to provide the outer surfaces of such components co-planar with the deck surface or other hull surface to which the module is mounted, so as to minimize any protrusions or disruptions along that surface.

Figure 8:
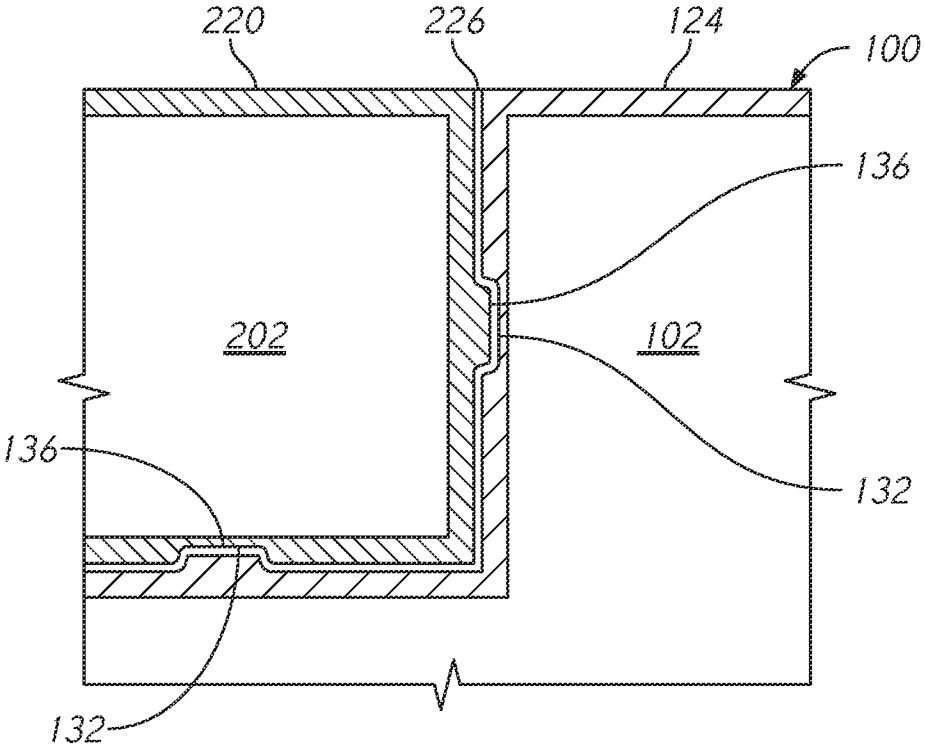
FIG. 8 is a simplified partial section view illustrating an interface between a module and a receiver structure in the hull of a boat, such as the boat in FIG. 1, according to examples herein.

In some embodiments, the module 202 may be configured to be removably coupled to the receiver structure (e.g., 129 or 129") via a sliding interface or joint. The sliding interface may be implemented using any suitable combination of tracks (or rails) and cooperating grooves. For example, as shown in FIG. 3 and also referring to the cross-section in FIG. 8, the receiver structure 129 may be equipped with one or more tracks or grooves, which extend longitudinally along one or more of the surfaces defining the recess 127. In one example, as shown in FIG. 3, each of the sidewalls 148 that defines surfaces 149 is provided with at least one longitudinal sliding member 132, in this case a track. In some embodiments, one or more sliding members 132, in this case two sliding members implemented as tracks and located on opposite sides of the centerline, may be provided in the first recessed surface 145. The sliding members 132 may be configured to slidably cooperate or engage corresponding sliding members 136 operatively arranged on the enclosure 220. In some embodiments, the sliding members 132 and/or sliding member 136 may be extend substantially along a straight line that runs substantially horizontally. In some embodiments, the sliding members 132 extending along the sidewalls 148 may be inclined to the horizontal, for example in a similar manner as the first recessed surface 145. In yet other examples, one or more of the sliding members 132 may be curved at least along a portion of their length. In some embodiments, the sliding interface or joint may be differently configured and/or include different or additional slidably components, such as one or more rollers, which may engage on one or both sides of a track and/or any other suitable types of sliders. In some embodiments, the sliding interface may be operable to be locked, upon installation of the module within the recess, to substantially prevent the relative movement of the sliding members until the interface is once again unlocked for removal of the module. This may be done by a latch or other suitable locking mechanism, Which may be located external to the hull or within the hull.

Figure 5:
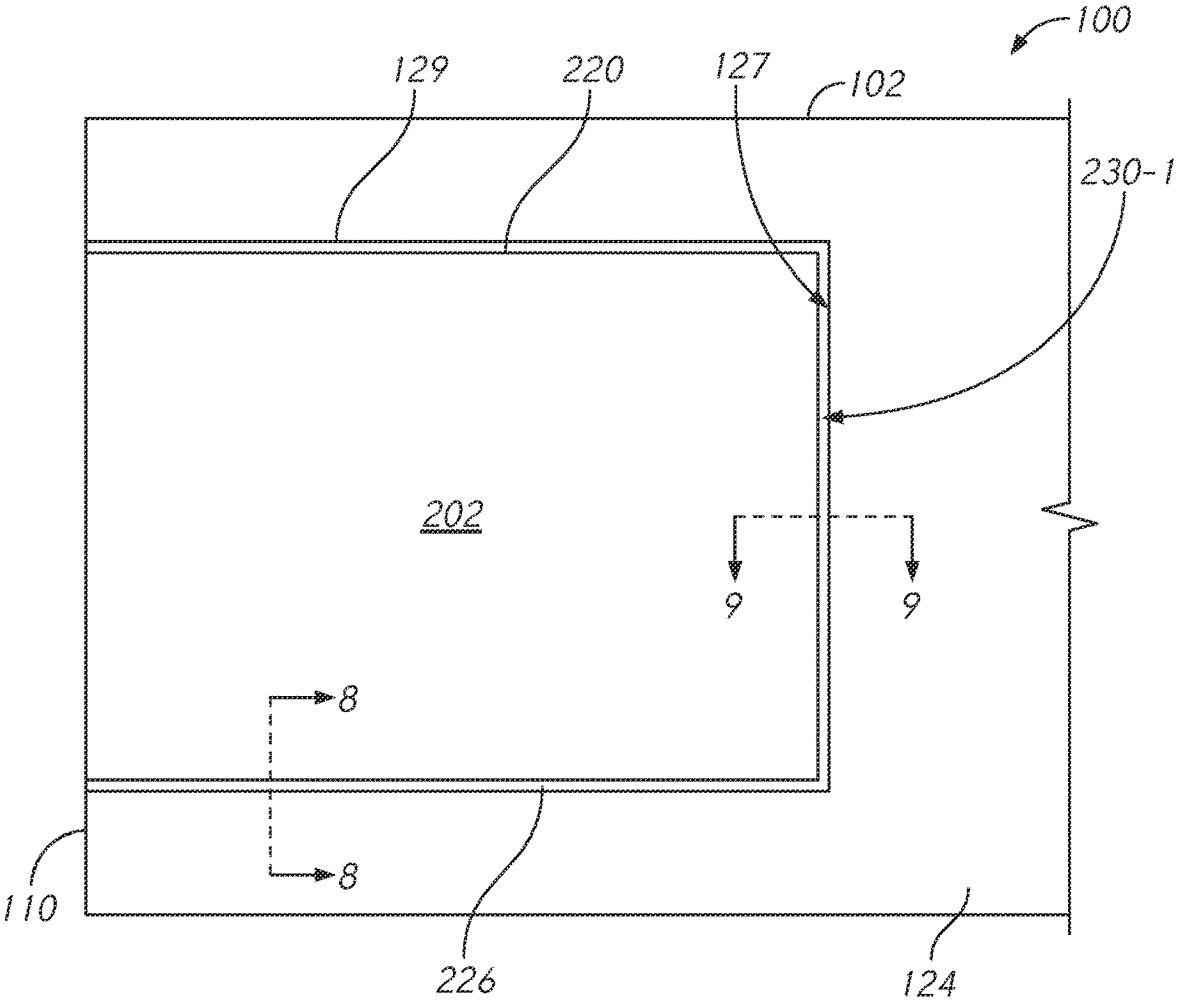
FIG. 5 is a simplified plan view of the stern portion of the boat in FIG. 1.
Figure 9:
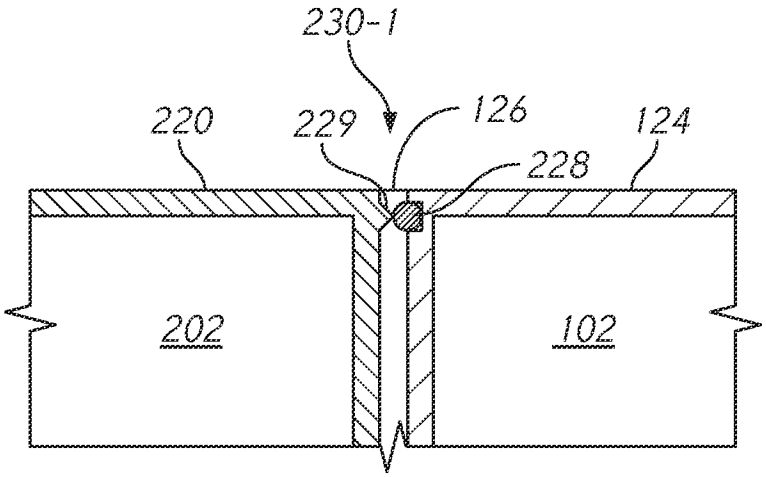
FIG. 9 is another simplified partial section view illustrating further aspects of a modular system interface, such as the interface shown in FIG. 8, in accordance with examples of the present disclosure.

As described, the recess 127 defined by the receiver structure may be watertight such that the seaworthiness of the vessel is unaffected by removal of the module. In other words, the boat 100 may be seaworthy even if a module is not attached to the receiver structure. For example, the receiver structure may be coupled to the opening in the hull via a substantially water-impermeable joint, such as a weld joint (e.g., using any conventional arc welding or friction stir welding). In other embodiments, such as in the case of composite construction, the receiver structure may be molded into the structure of the deck or may be a separate molded part, which may be tabbed and faired in the structure of the deck. In some embodiments, the module 202 and the receiver structure 129 may be configured to provide a substantially watertight joint when the module is coupled to the hull such as to reduce or eliminate the risk of water intrusion within the gap between the enclosure 220 and the receiver structure 129 when the enclosure 220 is coupled thereto. For example, one or more seals may be provided at any of the seams of the coupling interface 230 that would be exposed to the elements (e.g., to water and/or weather) when the boat is in use. In the present example, a first seal 224 may be provided along the perimeter of the mouth or opening of the recess 127 through the transom 110, and may thus also be referred to as transom seal. A second seal 226 may be provided along the perimeter of the mouth or opening of the recess 127 through the deck 124, and may thus also be referred to as a deck seal. The first and/or the second seals 224 and 226 may be implemented using a suitable flexible generally fluid-impermeable structure, such one or more strips of rubber (e.g., weather stripping) or other relatively hard resilient material, which is arranged to overhang the peripheral edge of the recess 127 (e.g., along the deck surface and/or the transom surface) by a sufficient amount to span the gap formed at the coupling interface 230. The seal members may be attached either to surfaces of the hull (e.g., the transom surface or the deck surface) or one or more of the seals may instead be coupled to the enclosure 220. In the present example, the deck seal 226 is attached to the surface of the deck 124 to overhang the opening of the recess 127 at the deck. The transom seal 224 is attached to the rear surface of the enclosure 220 such that it extends outward from the enclosure. When the enclosure 220 is inserted into the receiver structure 129, the deck seal 226 spans the gap between the enclosure 220 and the recess 127 along the deck 124, while the transom seal 224, which in this example is carried by the enclosure, spans the gap between the enclosure 220 and the recess 127 along the transom 110. As such a substantially water-tight seal may be formed between the enclosure 220 and the recess 127 to substantially prevent the ingress of water between the two when the boat is in use. Different types of seals may additionally or alternatively be used. For example, in some embodiments, a ridge-and-gasket seal assembly 227 may be used along at least a portion of the perimeter of the coupling interface, such as along the forward interface 230-1, as shown in FIGS. 5 and 9. The ridge-and-gasket seal assembly 227 may include a gasket 228 located on one side of the interface, in this example on the hull 102 side, and a ridge 229 located on the opposite side of the interface, in this case on the module 202 side. The gasket may be made from any suitable resilient material, such as rubber. The ridge 229 may be a protruding structure having a pointed, rounded or blunt and extending towards the seal so as to contact and/or compress the gasket, when the enclosure is coupled to the receiver structure. As such, the ridge-and-gasket seal assembly 227, which may be located near the upper surface of the enclosure 220 and the upper surface of the deck 124, may substantially prevent any water from entering the gap below the ridge-and-gasket seal assembly 227. A ridge-and-gasket seal assembly 227 may be used instead of or in combination with a deck seal 226.

Figure 4:
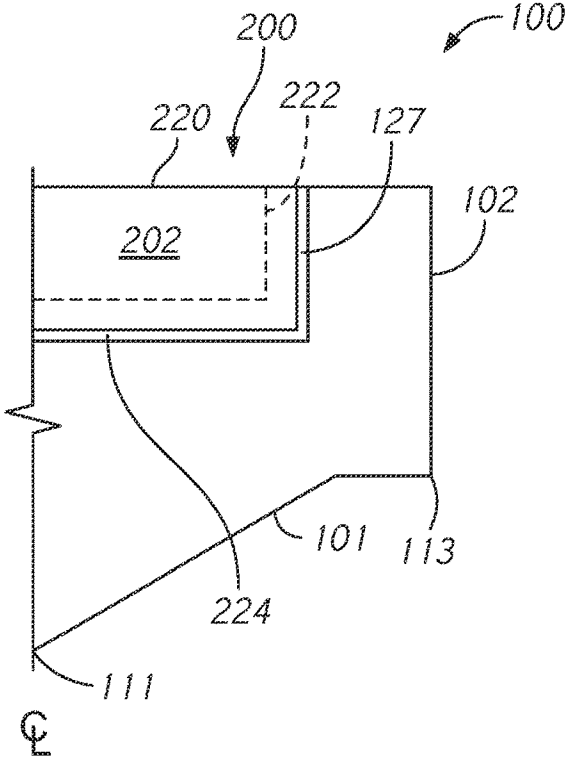
FIG. 4 is a simplified section view of the stern of the boat in FIG. 1.

Returning back to FIG. 2, and referring also to FIG. 4, the enclosure 220 of module 202 defines a module cavity 223 that houses an extendible ramp 210. The ramp 210 may be operatively received in the enclosure 220 and be extendable therefrom such that, when extended, the ramp 210 extends from the deck 124 of the landing craft toward a shore to provide a support surface for unloading cargo onto or in close proximity to the shore. As such, the ramp 210 may provide the function of ramp 160 of the boat 100 of FIG. 1. When not in use, the ramp 210 is fully retractable within the module cavity of the enclosure. The enclosure 220 has an opening 225 connecting the module cavity 223 to the outside of the enclosure 220. This opening 225, also referred to as the mouth of the module cavity 223, is sized to allow the ramp 210 to be extended from the cavity 223. The opening 225 is covered by a door 222, when the ramp 210 is retracted within the enclosure 220. In some embodiments, the enclosure 220 is configured to seal the cavity 223, e.g., by providing a substantially watertight seal at the opening 225, when the ramp 210 is retracted within the cavity 223. For example, a seal (not shown) may be provided along the perimeter of the door 222 and/or the opening 225 to provide a substantially water tight seal upon closure of the opening 225 by the door 222.

In some embodiments, the door 222 may be implemented using a hinged door or hatch, which may be pivotally coupled to the hull 102 along a hinge line that runs parallel to the deck 124 surface. For example, the door 222 may pivot upward and away from the transom 110, in embodiments in which the boat has a transom stern. Upon extension of the ramp 210, the door 222 may be pivoted down towards the extended ramp 210 to provide a secondary ramp surface that substantially fills any discontinuity or step between the deck surface and the support surface of the extendible ramp. In some embodiments, the hinge line may extend substantially along the rear edge of the deck. In other embodiments, the hinge line (or hinge lines, in the case of a double-door that opens about midway of the opening 225) may extend along a surface of the deck, either transversely or longitudinally along the deck 124. In some embodiments, the door 222 may be hinged elsewhere. For example, the door 222 may be arranged to pivot along a hinge line that is parallel to the transom, for example vertically, such as in cases where the boat has a square transom. In some such embodiments, the opening 225 in the enclosure that accommodates extension of the ramp 210 may be provided substantially on the rear side of the enclosure, which in the illustrated example is substantially co-planar with the outer surface of the transom 110. In other embodiments, the ramp 210 may be folded into its retracted configuration. In some such embodiments, the opening 225 for extending the ramp 210 may be located, at least in part, on the upper surface of the enclosure, which in this example is a surface that is substantially co-planar with the deck 124 surface. The door closing the opening may be implemented using any suitable closure mechanism, such as a pivoting or hinged door (e.g., a pivoting hatch), a sliding door, a hinged double-door, with the one or more door panels of door 222 being coupled to the enclosure using any suitable mechanism such as a simple (pin) hinge or more complex hinges and/or actuation/extension mechanisms arranged to provide the door 222 between the open and closed configuration.

The extendible ramp 210 may be implemented using any suitable structure configured to collapse in size and extend to a longer a size to provide a support surface of sufficient length to connect the deck to the shore. In one embodiment, the extendible ramp 210 may be provided by one or more telescoping ramp members. For example, a ramp 210' of a ramp module 202' having a first configuration may be configured to support a particular type of cargo, such as vehicles of certain weight and certain wheel track. The ramp 210' may include a first telescoping member 212-1 and a second telescoping member 212-2 spaced from the first telescoping member 212-1. The pair of telescoping members (e.g., the first and second telescoping members 212-1 and 212-2, respectively), when extended, may provide a support surface of sufficient width to accommodate a passage of a vehicle over it. The individual ramp structures (e.g., the telescoping members 212-1 and 212-2) may have a sufficient width to support the passage of a vehicle tire over the respective ramp structure. The pair of telescoping members may be arranged in relation to one another (e.g., by selecting an appropriate separating distance) to accommodate the wheel track of the type(s) of vehicles to be supported by the ramp 210' (e.g., a truck, a utility vehicle, or any other type of land vehicle). In some embodiments, the first and second telescoping members may be configured to extend and retract together. For example, the first telescoping member 212-1 may be connected to the second telescoping member 212-2 via one or more transverse members (e.g., shafts 213) that span the gap between the two telescoping members. A ramp 210 having a different configuration may be used in any one of the modules 202 of the present system. Any suitable combination of ramp structures, which may be extendible through telescoping, folding, or combination thereof, may be used to implement the extendible ramp 210 of any of the modules herein. The upper surfaces of the ramp structures may be provided with surface features (e.g., increased surface roughness, a higher friction coating, and/or protrusions or grooves) to increase the traction of the ramp surface(s).

Figure 7:
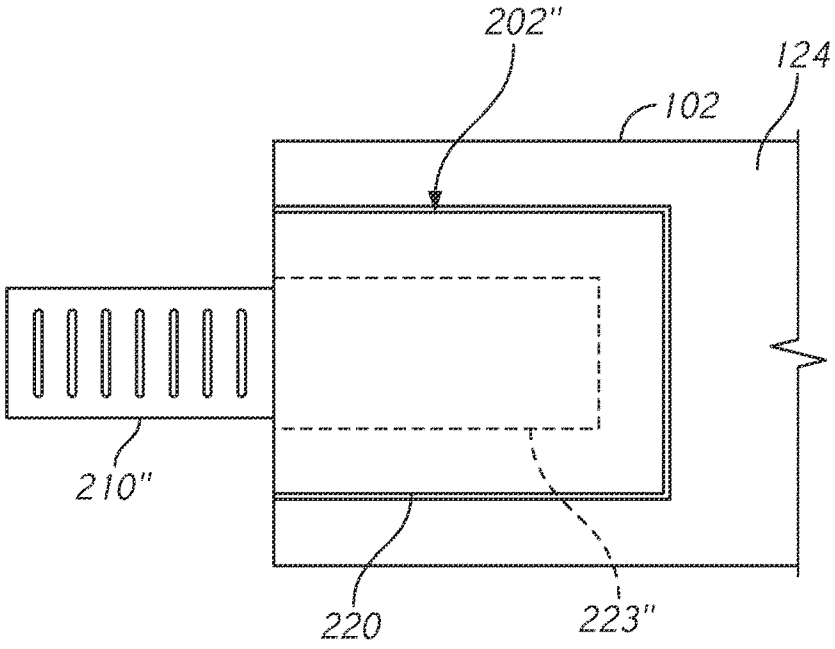
FIG. 7 is a simplified plan view of an extendible stern ramp for a boat, such as the boat in FIG. 1, according to further examples of the present disclosure.
Figure 6:
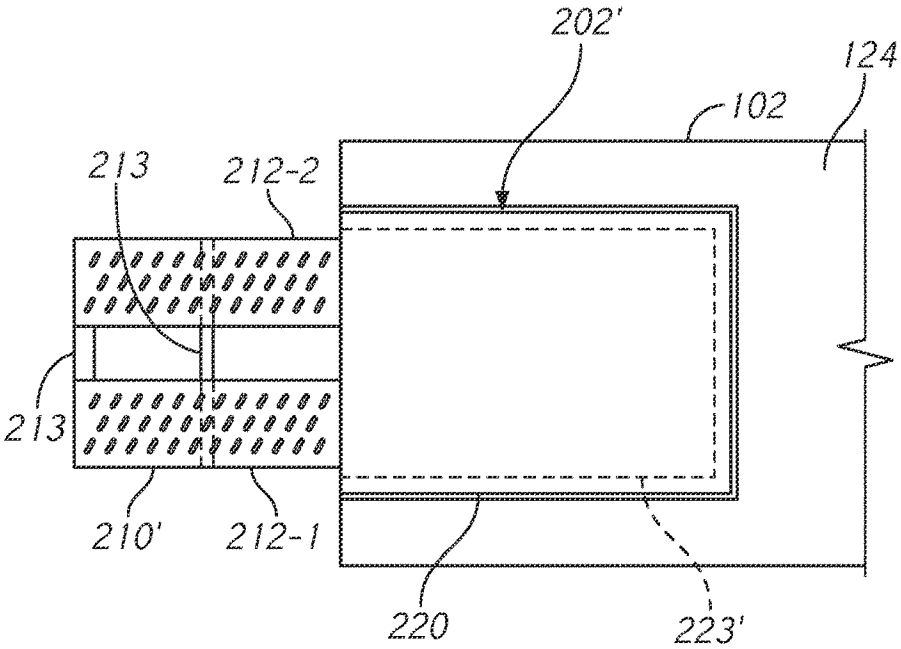
FIG. 6 is a simplified plan view of an extendible stern ramp for a boat, such as the boat in FIG. 1, according to some examples of the present disclosure.

The modular system 206, as the name implies, enables a relatively quick and easy interchange of one module with another (e.g., removing module 202' and replacing it with module 202") which may reconfigure the boat 100 for a different function or operation. To that end, each of the modules may have an enclosure 220 having substantially the same geometry and interface as any other of the modules in the system 206 but have different internal components to provide different functionality, such as ramps with different configurations (e.g., different geometries and/or load bearing capacities), or components that provide entirely different functions or no function at all (e.g., in the case of a dummy module used primarily to fill the recess 127 in the hull 102 without otherwise including a functional component inside). The modular system 206 may include multiple module, e.g., as part of a kit, that have different internal configuration and may thus provide different functions. For example, the modular system 206 may include a first module 202', as shown in FIG. 6, and a second module 202", as shown in FIG. 7, each of which is optimized for a different type of cargo. In some embodiments, one of the modules, e.g., first module 202', may include a an extendible ramp, e.g., first ramp 210', which is capable of supporting a first type of cargo (e.g., a vehicle) and another module, e.g., second module 202", may include an extendible ramp, e.g., second ramp 210", which is capable of supporting a second different type of cargo (e.g., personnel) but not the first type of cargo. Each of the first and second modules 202' and 202" may have and enclosure 220 that has substantially the same external geometry, to facilitate interchangeability, but may have different module cavities (e.g., a first cavity 223' and a second cavity 223", respectively) and may contain different internal components (e.g., two different ramps). In other words the second ramp module has an enclosure that has the same geometry and interface as that of the first ramp module but instead contains an extendible ramp of a different configuration. In some such embodiments, the internal cavity of the enclosure may be different, although in some cases, the internal cavity of the enclosure may remain substantially the same however the structure that couples the extendible ramp and/or the structure facilitating extension of the second ramp (including the door and/or size(s) of any openings in the enclosure) may be different to accommodate a ramp of a different configuration.

As described above, in some embodiments, the module may be differently coupled to the receiver structure. In some embodiments, the module may be inserted into the cavity along an insertion direction that may be substantially parallel to the surface in which the opening is formed. For example, the module may be lowered into the cavity from above the deck surface in examples in which the cavity is formed, at least in part, in the deck surface. Optionally, the module may be rotated during the insertion, for example toward or away from the direction of insertion. As shown in FIGS. 10A and 10B, the receiver structure may be operatively coupled to an opening in the hull so as to form a mouth only along one hull surface (e.g., the deck 124 surface or the transom 110 surface). In such embodiments, the module may be insertable into the transom opening or the deck opening by moving the module (e.g., lowering using a crane or gantry, or otherwise bringing the module closer to the opening) substantially in a direction normal to the hull surface in which the opening is formed. The module may be coupled to the receiver via any suitable technique, such as by welding, clamping or bolting the module to the receiver structure.

As described herein, and in accordance with some examples, a boat may be provided having a removable modular stern ramp for loading cargo and people onto the boat. In some embodiments, the modular ramp may be configured for loading and/or unloading cargo from a dock or another vessel or structure that may be located substantially parallel with or at a higher elevation than the deck of the boat 100. In such embodiments, the extendable portion of the module (e.g., the extendable ramp) may be configured to extend in a direction that is parallel with or inclined upward relative to the deck of the boat. In some embodiments, the modular ramp system may be configured to loading and/or unloading cargo directly onto the body of water on which the landing craft is floating. For example the modular ramp system may be configured to launch and recover an autonomous marine vehicle, such as but not limited to an autonomous underwater vessel (AUV) or others, and/or for launching and recovering a smaller watercraft, such as a rubber raiding craft, an inflatable craft, a lifeboat, jet ski, an advanced rescue craft, or other small watercraft. In some embodiments, a modular ramp system may provide a plurality of ramps, different ones of which are configured for specific type of cargo, for example one module may be configured launch and recovery of a small watercraft, one may be configured for launch and recovery of a submersible vessel such as an AUV. Optionally additional ramps may be configured for landing and unloading onto or in close proximity to ground-based structures (e.g., directly on the ground, or on a dock). In further examples, the extendible ramp may be configured to articulate, for example upward relative to the boat's deck surface so as to enable loading from and unloading to surfaces that are elevationally above the boat's deck, and/or downward, for example for launching a submersible vessel into the surrounding water. The ramp may be a telescoping ramp that is fully enclosed in a cassette removably mounted within a stern portion of the boat. The cassette may be fully received in an opening in the stern. A cassette having a same geometry may be equipped with ramps for different purposes such as ramps for loading vehicles or ramps for loading personnel. The boat may have a dummy or non-functional cassette in operational conditions, where unloading cargo is not part of the operational capability of the boat The cassette may be mountable to the boat in a watertight manner such that intrusion of water within the interior of the cassette is prevented.

The foregoing description has broad application. The discussion of any embodiment is meant only to be explanatory and is not intended to suggest that the scope of the disclosure, including the claims, is limited to these examples. In other words, while illustrative embodiments have been described in detail herein, the inventive concepts may be otherwise variously embodied and employed, and the appended claims are intended to be construed to include such variations, except as limited by the prior art. The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

What is claimed is:

1. A landing craft comprising:

an outer hull having a bow and a stern, the stern comprising a transom;

a deck having a deck surface spanning at least a portion of the distance between the bow and the stern;

a receiver structure secured to an opening in the outer hull at the transom to define a watertight recess extending from the outer hull at the transom forward, towards the bow, wherein the recess is formed to extend below the deck surface; and a ramp module removably coupled to the receiver structure filling the opening, wherein the ramp module comprises:

an enclosure removably coupling the ramp module to the receiver structure; and a ramp configured to be extended from the enclosure toward a shore to provide a support surface for loading and unloading of cargo, and wherein the ramp is configured to be substantially fully retracted within the enclosure; and a door configured to close an opening in the enclosure sized to accommodate passage of the ramp therethrough, wherein the door is pivotally coupled to the enclosure at a hinge line substantially parallel with the deck surface, and wherein the ramp provides a first ramp surface and the door, when opened, provides a second ramp surface extending from the deck to the first ramp surface.

2. The landing craft of claim 1, wherein the enclosure is configured to enclose the ramp within the enclosure in a watertight manner.

3. The landing craft of claim 1, wherein an interface between the receiver structure and the enclosure is watertight when the module is coupled to the receiver structure.

4. The landing craft of claim 1, wherein the ramp module is substantially fully accommodated within the watertight recess.

5. The landing craft of claim 1, wherein the receiver structure is slidably coupled with the enclosure.

6. The landing craft of claim 1, wherein the landing craft is a variable displacement watercraft comprising an internal ballast system for selectively and controllably varying a vertical and longitudinal center of gravity of the vessel.

7. The landing craft of claim 1, wherein the receiver structure extends to the deck, and wherein the enclosure forms a watertight interface with surfaces of the deck and the transom when the module is coupled to the receiver structure.

8. The landing craft of claim 1, wherein the enclosure has at least one external wall which is substantially flush with a surface of the outer hull at the transom when the module is coupled to the receiver structure to provide a substantially continuous profile along the transom.

9. The landing craft of claim 1, wherein the module is a first module, the landing craft further comprising a second module configured to be removably coupled to the receiver structure in place of the first module.

10. The landing craft of claim 9, wherein the extendible ramp of the first module is configured to support passage of a first type of cargo, wherein the second module comprises an extendible ramp configured to support passage of a second type of cargo but not the first type of cargo.

11. A modular ramp system for a landing craft, comprising:

a ramp module configured to be removably coupled to a hull of the landing craft, the ramp module comprising:

an enclosure defining a cavity therein, wherein the enclosure is configured to be removably received in a watertight recess in the hull of the landing craft;

an extendible ramp operatively coupled to the enclosure and configured to be extended from the enclosure such that the ramp extends from the deck of the landing craft toward a shore to provide a support surface for unloading cargo, and wherein the extendible ramp is configured to be substantially fully retracted within the cavity, wherein the enclosure is configured to seal the cavity watertight when the ramp is retracted within the cavity; and a door operatively coupled to the enclosure to cover an opening in the enclosure sized for passage of the extendible ramp therethrough, wherein the door is hinged to the enclosure at a hinge line parallel with the deck and wherein the door is configured to pivot upward and away from a transom of the landing craft for opening the door and wherein the door is further configured to provide a ramp between the deck surface and the support surface of the extendible ramp.

12. The modular ramp system of claim 11, wherein the extendible ramp comprises one or more telescoping ramp structures.

13. The modular ramp system of claim 12, wherein the extendible ramp comprises a first telescoping member and a second telescoping member spaced apart from the first telescoping member by a gap, the first telescoping member, when extended, providing a first support surface of sufficient width to accommodate a passage of a vehicle tire over the first support surface, and a second telescoping member, when extended, providing a second support surface of sufficient width to accommodate the passage of a vehicle tire over the second support surface.

14. The modular ramp system of claim 13, wherein the first and second telescoping members are operatively connected to extend and retract together.

15. The modular ramp system of claim 11, wherein the enclosure is configured to seal the cavity watertight when the ramp is retracted within the cavity.

16. The modular ramp system of claim 11, wherein the enclosure is configured for slidably coupling to the watertight recess of the landing craft.

17. The modular ramp system of claim 11, wherein the watertight recess is defined by a first recessed surface located below a surface of the deck, a second recessed surface located forward of the transom stern, and a pair of opposing side surfaces, each of the opposing side surfaces connecting corresponding sides of the first and second recessed surfaces.

18. The modular ramp system of claim 11, wherein the enclosure forms a watertight interface with the surface of the deck and the transom stern when the ramp module is coupled to the outer hull of the landing craft.

19. The modular ramp system of claim 11, wherein the ramp module is a first module, the system further comprising a second dummy module configured to be removably coupled to the watertight recess of the landing craft, the second dummy module comprising a dummy enclosure having a same geometry and coupling interface as the enclosure of the first module, wherein the second dummy module does not include a ramp.

20. The modular ramp system of claim 11, wherein the ramp module is a first module and wherein the extendible ramp of the first module has a first configuration, the system further comprising a second ramp module comprising a second enclosure configured to be removably coupled to the watertight recess of the landing craft, the second ramp module further comprising a second extendible ramp having a second configuration different from the first configuration.

* * * * *